US006959096B2

(12) United States Patent
Boone et al.

(10) Patent No.: US 6,959,096 B2
(45) Date of Patent: Oct. 25, 2005

(54) SOUND REPRODUCTION SYSTEM

(75) Inventors: Marinus Marias Boone, Zoetermeer (NL); Diemer De Vries, Berkel en Rodenrijs (NL); Ulrich Horbach, Daenikon (CH)

(73) Assignees: Technische Universiteit Delft, AA Delft (NL); Studer Professional Audio Equipment, Regensdorf (CH)

( * ) Notice: Subject to any disclaimer, the term of this patent is extended or adjusted under 35 U.S.C. 154(b) by 0 days.

(21) Appl. No.: 10/432,324

(22) PCT Filed: Nov. 20, 2001

(86) PCT No.: PCT/NL01/00843

§ 371 (c)(1),
(2), (4) Date: Jan. 8, 2004

(87) PCT Pub. No.: WO02/43437

PCT Pub. Date: May 30, 2002

(65) Prior Publication Data

US 2004/0114774 A1 Jun. 17, 2004

(30) Foreign Application Priority Data

Nov. 22, 2000 (EP) ..... 00204142

(51) Int. Cl.[7] ..... H04R 25/00
(52) U.S. Cl. ..... 381/152; 381/61; 381/182
(58) Field of Search ..... 381/17, 18, 306, 381/310, 58, 59, 61–63, 333, 117–119, 182, 152, 388, 431; 84/622, 629, 659; 352/27, 37

(56) References Cited

U.S. PATENT DOCUMENTS 5,142,586 A * 8/1992 Berkhout ..... 381/63
6,332,029 B1 * 12/2001 Azima et al. ..... 381/152
6,389,935 B1 * 5/2002 Azima et al. ..... 381/388

* cited by examiner

*Primary Examiner*—Huyen Le
(74) *Attorney, Agent, or Firm*—Young & Thompson

(57) ABSTRACT

Arrangement of a sound reproduction system (1), including at least one input (2), a sound field generator (4), a loudspeaker panel (10); the at least one input (2) connected to the sound field generator (4), and the sound field generator (4) connected to the loudspeaker panel (10); the at least one input (2) arranged for generating an audio signal; the sound field generator (4) including a wave field synthesizer (6) arranged for generating a spatially perceptible sound field for the audio signal and for outputting the spatially perceptible sound field to the loudspeaker panel (10), the loudspeaker panel (10) being a multi-exciter Distributed Mode Loudspeaker panel (10) consisting of a plate (12) and a plurality of transducers (16), arranged within an array (14) on the large plate (12) for reproducing the spatially perceptible sound field from the wave field synthesizer (6) by exciting bending waves in the plate (12).

11 Claims, 1 Drawing Sheet

SOUND REPRODUCTION SYSTEM

FIELD OF THE INVENTION

The present invention relates to a sound reproduction system as defined in the preamble of claim 1.

PRIOR ART

Such a sound reproduction system is known from EP 0 335 468 A1, in which a sound reproduction system that makes use of physical and perceptual laws of sound field generation and human perception is described.

The principle of the sound generation method is called Wave Field Synthesis (WFS). This method has been published by A. J. Berkhout, in: "A Holographic Approach to Acoustic Control", J. Audio Eng. Soc. 36, pp. 977–995 (1988). In this concept, wave theory plays an essential role and individual loudspeakers are replaced by loudspeaker arrays (or "loudspeaker-strips") that generate wave fronts from true or notional sources. Unlike all existing methods, the wave front solution is a so-called volume solution that generates an accurate representation of the original wave field in the entire listening space (and not at one or a few listening spots). In the ideal situation the listening area is surrounded by planes of loudspeakers, which are fed with signals so that they produce a volume flux proportional to the normal component of the particle velocity of the original sound field at the corresponding position. For practical purposes, this method has been adapted to make use of linear loudspeaker arrays surrounding the listening area, rather than planes of loudspeakers.

Thus, the method relies on sending pre-processed audio signals to arrays of loudspeakers. Up to now, applications of this technology have been realised with the use of conventional loudspeaker drivers, consisting of an electromagnetic transducer and a cone. The transducers are mounted in loudspeaker boxes and combined in a row to obtain the desired loudspeaker arrays.

Because of the large number of loudspeakers needed for adequate wave field synthesis, and the fact that these loudspeakers should be positioned around the listening area, the use of conventional electro-dynamic loudspeakers has important disadvantages. One disadvantage of normal electro-dynamic loudspeaker drivers is that they need a housing with a relatively large volume to avoid the additional stiffness of the back-volume. Another disadvantage is the cost of those loudspeakers.

A new development on loudspeakers are the so called Distributed-Mode Loudspeakers (DML). Such loudspeakers consist of a plate of light and stiff material in which bending waves are excited by an electromagnetic exciter, which is fed with the desired audio signal. The arrangement and method of Distributed Mode Loudspeakers has been described by N. Harris and M. O. Hawksford in "The distributed-mode loudspeaker (DML) as a broadband acoustic radiator", preprint 4526, 103$^{rd}$ convention of the AES, New York, 1997.

However, the distributed mode properties have their influence on the radiation characteristics, in temporal and spatial sense. Hence, the applicability of these panels for WFS, where the phase relations between the secondary sources (the loudspeakers) is so important is not evident from the beginning. M. M. Boone and W. P. J. de Brujin report on the applicability of Distributed Mode Loudspeakers as output device for WFS generated sound in: M. M. Boone and W. P. J. de Brujin, "on the applicability of distributed mode loudspeaker panels for wave field synthesis based sound reproduction", preprint 5165, 108$^{rd}$ Convention of the AES, Paris, 2000.

Further, a disadvantage of DML technology is that the bending wave radiation leads to an unwanted irregularity in the frequency spectrum of the transfer function (the Fourier transform of the impulse response).

Moreover, as discussed for conventional electro-dynamic loudspeakers, for proper sound reproduction, an array consisting of a large number of separate DML loudspeakers is required. Each of these loudspeakers has to be placed into the larger WFS array, which requires additional (complex) wiring and additional assembly time and costs.

SUMMARY OF THE INVENTION

It is an object of the arrangement and method of a sound reproduction system of the present invention to provide a Wave Field Synthesis system using a Distributed Mode Loudspeaker panel, which does not possess the disadvantages related to the arrangement of Boone and de Brujin.

Thus, the present invention relates to an arrangement of a sound reproduction system, comprising at least one input source, a sound field generator, a loudspeaker panel; said at least one input source being connected to said sound field generator, and said sound field generator being connected to said loudspeaker panel; said at least one input source being arranged for generating an audio signal; said sound field generator comprising a wave field synthesiser being arranged for generating a spatially perceptible sound field for said audio signal and for outputting said spatially perceptible sound field to said loudspeaker panel, characterised in that said loudspeaker panel is a multi-exciter Distributed Mode Loudspeaker panel comprising a plate and a plurality of transducers; said plurality of transducers being arranged within an array on said plate for reproducing said spatially perceptible sound field from said wave field synthesiser by exciting bending waves in said plate.

Also, the present invention relates to an arrangement of a sound reproduction system, as described above, characterised in that said sound field generator further comprises an input filtering device being arranged for applying an inverse filtering process on said audio signal to compensate for frequency spectrum irregularities of a set of transducers of the multi-exciter Distributed Mode Loudspeaker panel associated with said at least one input source.

In addition, the present invention relates to an arrangement of a sound reproduction system, as described above, characterised in that said input filtering device carries out said inverse filtering process before generating said spatially perceptible sound field for said audio signal by said wave field synthesiser.

Moreover, the present invention relates to an arrangement of a sound reproduction system, as described above, characterised in that said input filtering device carries out said inverse filtering process after generating said spatially perceptible sound field for said audio signal by said wave field synthesiser.

Further, the present invention relates to an arrangement of a sound reproduction system as described above, characterised in that said multi-exciter Distributed Mode Loudspeaker panel is arranged for outputting said spatially perceptible sound field for said audio signal at an acoustic level by generating first wave fronts in said spatially perceptible sound field for creating a spatial perception in said spatially perceptible sound field and by generating second wave fronts as a diffuse part of said spatially perceptible sound field for controlling said acoustic level.

Furthermore, the present invention relates to an arrangement of a sound reproduction system, as described above, characterised in that said array is at least one line array.

Also, the present invention relates to an arrangement of a sound reproduction system, as described above, characterised in that said at least one line array is a linear or non-linear array.

Further, the present invention relates to an arrangement of a sound reproduction system, as described above, characterised in that said at least one input source comprises a sound object as defined in MPEG-4 as a virtual input source.

The present invention relates to an arrangement of a sound reproduction system, as described above, characterised in that said arrangement is arranged to carry out at least one of the following functions:

Direct speech enhancement in a theatre;

Sound reproduction in a cinema;

Surround sound reproduction of audio only and audio in combination with video in a home theatre;

Sound reproduction in a virtual reality theatre;

Sound reproduction in a simulator;

Sound reproduction for auralization;

Sound reproduction for teleconferencing.

Moreover, the present invention relates to a method of reproducing sound by an arrangement of a sound reproduction system, as described above, comprising the steps:

to generate an audio signal;

to generate a spatially perceptible sound field for said audio signal;

characterised by the following steps:

to output said spatially perceptible sound field to a multi-exciter Distributed Mode Loudspeaker panel comprising a plate and a plurality of transducers; said plurality of transducers being arranged within an array on said plate;

to reproduce said spatially perceptible sound field by exciting bending waves in said plate by said plurality of transducers.

Also, the present invention relates to a method of reproducing sound, as described above, characterised by the further step of applying an inverse filtering process on said audio signal to compensate for frequency spectrum irregularities of a set of transducers of the multi-exciter Distributed Mode Loudspeaker panel, associated with said audio signal.

In the present invention the loudspeaker panel is a multi-exciter Distributed Mode Loudspeaker panel which consists of a single large plate of light stiff material in which bending waves are excited by arrays of transducers. These transducers are fed with the steering signals, needed to obtain the WFS sound field. The functionality of this approach is based on the fact that the impulse response of a DML consists of a short pulse, caused by the direct radiation of the plate at the position of the exciter, and a random pattern caused by the radiation of the diffuse bending wave patterns that are subsequently excited in the panels. The first parts of the impulse responses of all transducers of the plate have a good phase relationship between each other and are thus able to synthesise a high quality sound field as needed for WFS. The later parts of the impulse responses are more or less randomly related and they are responsible for getting a sufficient high output of the bending wave plate.

To work properly, the relation between the early, in phase generated sound field and the later, diffuse generated sound field must be such that the first wave fronts lead to the desired spatial perception of the sound, while the later part of the response gives sufficient output without negative effects on the spatial perception. This can be optimised by the choice of the right material for the bending wave plate to be used. The size of the multi-exciter Distributed Mode Loudspeaker panel is optimised for radiation over a wide frequency range from 100 to 20,000 Hz.

Due to the use of light-weight and stiff material, the multi-exciter Distributed Mode Loudspeaker panel can have a small volume in combination with a relatively large area (in comparison with the electro-dynamic loudspeaker arrays from the prior art).

Moreover, the wiring of a multi-exciter Distributed Mode Loudspeaker panel can be integrated into the panel, which simplifies the installation of such a panel and reduces additional wiring and assembly time and costs.

Furthermore, in the present invention an input filtering procedure of an inverse filter is applied to correct the irregularities in the frequency spectrum of the transfer function of the transducers in the multi-exciter Distributed Mode Loudspeaker panel.

BRIEF DESCRIPTION OF DIAGRAMS

Below, the invention will be explained with reference to some drawings, which are intended for illustration purposes only and not to limit the scope of protection as defined in the accompanying claims.

DESCRIPTION OF PREFERRED EMBODIMENTS

Figure 1:
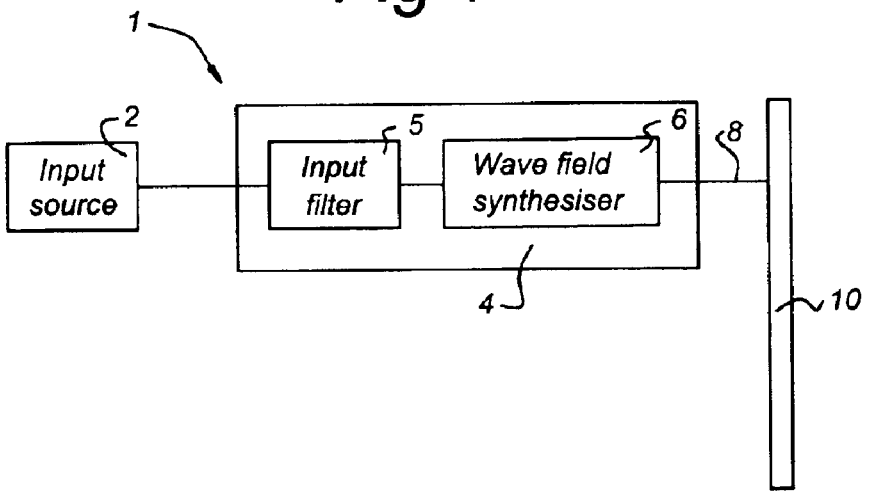
FIG. 1 shows a schematic block diagram of an arrangement of a sound reproduction system according to the present invention.

FIG. 1 shows a general overview of a sound reproduction system 1 according to the present invention. In this preferred embodiment, an input source 2 is connected to a sound field generator 4. The sound field generator 4 comprises an input filtering device 5 and a Wave Field Synthesiser 6, which also has an output connection 8 to a multi-exciter Distributed Mode Loudspeaker panel 10.

Figure 2:
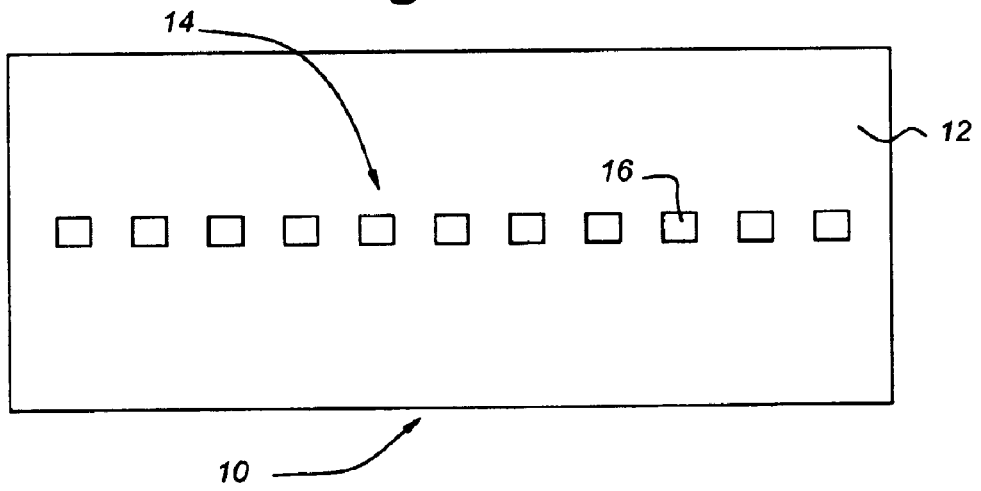
FIG. 2 shows a schematic plane view of a loudspeaker panel according to the present invention.

FIG. 2 shows a schematic panel view of a loudspeaker panel 10 according to the present invention. Multi-exciter Distributed Mode Loudspeaker panel 10 consists of a large plate 12 of a light and stiff material in which a plurality of transducers 16 is arranged. Preferably, the transducers 16 are ordered within a horizontal line array 14. The horizontal direction is defined here in relation to the earth's surface. In the large plate 12 of multi-exciter Distributed Mode Loudspeaker panel 10, transducers 16, in use, generate bending waves, for reproducing sound. In this embodiment, the multi-exciter Distributed Mode Loudspeaker panel 10 comprises a single line array 14, but the panel 10 may comprise more line arrays 14 which are positioned in parallel with a vertical spacing between them.

Moreover, in this preferred embodiment, the transducers 16 in the line array 14 are positioned using a constant spacing between the transducers 16, thus forming a linear line array. Alternatively, the transducers 16 in the line array 14 may be positioned using a non-constant spacing between the transducers 16. In that case, a non-linear line array 14 can be formed.

Figure 3:
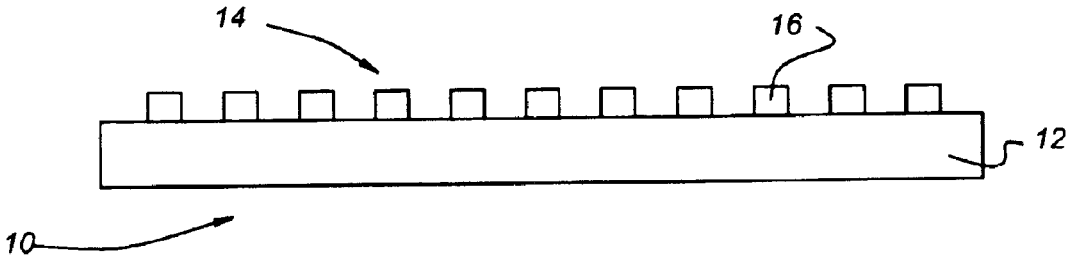
FIG. 3 shows a schematic cross-sectional view of a loudspeaker panel according to the present invention.

FIG. 3 shows a schematic cross-sectional view of a loudspeaker panel 10 according to the present invention.

The input source 2 is capable of transmitting an audio signal to the sound field generator 4. The audio signal may comprise a real-time audio source, or a recorded audio source. In the sound reproduction system 1 more than one input source 2 may be available. For example, a sound registration may register specific separate input sources within a larger source, such as separate instruments within an orchestra.

In FIG. 1, the audio signal from the input source 2 is filtered in input filtering device 5 before entering the Wave Field Synthesiser 6. Due to the fact that in DML technology, generation of bending wave radiation leads to an unwanted irregularity in the frequency spectrum of the transfer function (the Fourier transform of the aforementioned impulse response), an inverse filtering procedure, as known in the art, in input filtering device 5 can very well compensate for the general shape of this irregularity. In combination with the use of WFS technology, for which digital signal processing is already implemented (usually by the use of one or more digital signal processors), such a correction can easily be implemented.

The filtered audio signal is then transmitted to the Wave Field Synthesiser 6. From the filtered audio signal the Wave Field Synthesiser 6 generates output signals for the transducers. These output signals for the transducers are transmitted to the multi-exciter Distributed Mode Loudspeaker panel 10. Due to the characteristics of Wave Field Synthesis that the (original) location of the input source 2 (during registration) is simulated, the output signals for the transducers are fed only to those transducers 16 that are actually required for the reproduction of the sound at the simulated (original) location of the input source 2.

In Wave Field Synthesis, for each separate source to be reproduced a separate input source 2 is required. Accordingly, each input source 2 corresponds to an output (of output signals for the transducers) to a different group (combination) of transducers 16. For each source 2, signals are sent to a part of the transducers. The number of transducers, which are actuated, depends on the source 2 to be simulated. Typically, a sound reproduction system 1 of the present invention comprises e.g., 8 input sources 2 and 128 transducers 16. In such a case, one input source 2 may actuate e.g., 32 transducers.

In the plate 12 of the multi-exciter Distributed Mode Loudspeaker panel 10, the wiring of the transducers 16 can be incorporated and adapted in such a way, that connecting of the outputs of the Wave Field Synthesiser 6 to the transducers 16 is simplified. Furthermore, it is noted that electronic drivers needed for driving the transducers 16 may also be incorporated in the panel 10. Also, it is conceivable to integrate the Wave Field Synthesiser 6 into the panel 10.

It is noted that, in the embodiment described above, the inverse filtering procedure is done by an input filter 5, before the audio signal of the input source 2 enters the Wave Field Synthesiser 6. It is conceivable, however, to perform the inverse filtering procedure after synthesising the sound field in the Wave Field Synthesiser 6, before the output signal is fed through output connection 8 to the transducers of the multi-exciter Distributed Mode Loudspeaker panel 10. Although possibly more expensive, filtering may be then done for a group of transducers, or for individual transducers, related to a specific input source 2. It is also conceivable that the input filtering device 5 is integrated in Wave Field Synthesiser 6.

The acoustic signal processing can very well be based on MPEG-4 technology, such that each sound object (such as a single instrument in an orchestra) can be treated as a separate virtual source (i.e., inputted by separate input sources 2). In addition, steering parameters can control the generation of reflections and reverberation in accordance with the WFS principle. The method is also well suited for compatible reproduction of standard audio material, such as 2-channel stereophony and discrete surround sound according to, for instance, the 5.1 format.

Application of the arrangement of the present invention can be found in all instances where high quality surround sound reproduction is needed. Such applications are:

Direct speech enhancement in theatres;

Cinemas;

Surround sound reproduction of audio only and audio in combination with video for home theatres;

Virtual reality theatres;

Simulators;

Auralisation;

Teleconferencing.

All applications have in common that a high quality spatial sound reproduction can be accomplished over a large listening area. Although these high quality results could as well be obtained with WFS in combination with conventional loudspeakers, the application of a multi-exciter Distributed Mode Loudspeaker panel 10 has important advantages, because the transducer arrays can be mounted to the walls in a non obstructive way. For some of the mentioned applications the benefit is also that the panel surface can be used for video- or film projection. In other applications the surface can be treated by painting or other means to harmonise with the interior of the venue.

The transducers 16 of the multi-exciter Distributed Mode Loudspeaker panel 10 are embedded in a light-weight and stiff plate, which size typically corresponds to the envelope of a group of conventional loudspeaker arrays as used in the prior art. As an example, the loudspeaker panel 10 as shown in FIGS. 2 and 3 may have a length of 2 m. The height of the panel 10 is related to the ability to generate bending waves within the plate, which depends on the frequency characteristics to be obtained and the mechanical properties of the plate material. Typically, the minimal height of a loudspeaker panel 10 would be approximately 40 cm. Such a panel may easily be installed at (one of) the walls of a listening room. If a loudspeaker panel 10 of a larger area is needed, additional panels can be installed next to each other to form one large composite panel.

Further, it is noted that the multi-exciter Distributed Mode Loudspeaker panel 10 preferably must have a low weight in order to facilitate the installation of such a large size panel. Also, for adequate acoustical properties of the multi-exciter Distributed Mode Loudspeaker panel 10, the material of the panel 10 must have suitable mechanical properties such as a relatively high stiffness. Materials that may satisfy the given requirements, encompass thermohardening plastics, for example, Lexan, and composite laminated and layered materials.

Furthermore, the panel 10 as shown in FIGS. 2 and 3 is normally used with the transducer line array 14 being directed parallel to the earth's horizontal direction. However, it is conceivable to install the panel 10 at a given location, with the line array 14 being directed parallel to the vertical direction in relation to the earth's surface. In that case, the loudspeaker panel according to the present invention, may be used for sound field generation techniques such as beam-forming technology, in which directional sound, directed at a group of one or more listeners, is required. For that application, preferably, a non-linear spacing of the transducer line array 14 may be used.

What is claimed is:

1. Arrangement of a sound reproduction system (1), comprising at least one input source (2), a sound field generator (4), a loudspeaker panel (10); said at least one input source (2) being connected to said sound field generator (4), and said sound field generator (4) being connected to said loudspeaker panel (10); said at least one input source (2) being arranged for generating an audio signal; said sound field generator (4) comprising a wave field synthesiser (6) being arranged for generating a spatially perceptible sound field for said audio signal and for outputting said spatially perceptible sound field to said loudspeaker panel (10), characterised in that said loudspeaker panel (10) is a multi-exciter Distributed Mode Loudspeaker panel (10) comprising a plate (12) and a plurality of transducers (16); said plurality of transducers (16) being arranged within an array (14) on said plate (12) for reproducing said spatially perceptible sound field from said wave field synthesiser (6) by exciting bending waves in said plate (12).

2. Arrangement of a sound reproduction system (1), according to claim 1, characterised in that said sound field generator (4) further comprises an input filtering device (5) being arranged for applying an inverse filtering process on said audio signal to compensate for frequency spectrum irregularities of said plurality of transducers (16) of the multi-exciter Distributed Mode Loudspeaker panel (10) associated with said at least one input source (2).

3. Arrangement of a sound reproduction system (1), according to claim 2, characterised in that said input filtering device (5) carries out said inverse filtering process before generating said spatially perceptible sound field for said audio signal by said wave field synthesiser (6).

4. Arrangement of a sound reproduction system (1), according to claim 2, characterised in that said input filtering device (5) carries out said inverse filtering process after generating said spatially perceptible sound field for said audio signal by said wave field synthesiser (6).

5. Arrangement of a sound reproduction system (1) according to claim 1, characterized in that said multi-exciter Distributed Mode Loudspeaker panel (10) is arranged for outputting said spatially perceptible sound field for said audio signal at an acoustic level by generating first wave fronts in said spatially perceptible sound field for creating a spatial perception in said spatially perceptible sound field and by generating second wave fronts as a diffuse part of said spatially perceptible sound field for controlling said acoustic level.

6. Arrangement of a sound reproduction system (1), according to claim 1, characterised in that said array (14) is at least one line array.

7. Arrangement of a sound reproduction system (1), according to claim 6, characterised in that said at least one line array is a linear or non-linear line array.

8. Arrangement of a sound reproduction system (1), according to claim 1, characterised in that said at least one line source (2) comprises a sound object as defined in MPEG-4 as a virtual input source.

9. Arrangement of a sound reproduction system (1), according to claim 1, characterised in that said arrangement is arranged to carry out at least one of the following functions:

Direct speech enhancement in a theatre;

Sound reproduction in a cinema;

Surround sound reproduction of audio only and audio in combination with video in a home theatre;

Sound reproduction in a virtual reality theatre;

Sound reproduction in a simulator;

Sound reproduction for auralization; and

10. Arrangement of a sound reproduction system (1), according to claim 6, characterised in that said at least one line array is being directed in a substantially horizontal direction in relation to the earth's surface.

11. Arrangement of a sound reproduction system (1), according to claim 6, characterised in that said at least one line array is being directed in a substantially vertical direction in relation to the earth's surface.

* * * * *